US007513201B2

(12) United States Patent
Tseng

(10) Patent No.: US 7,513,201 B2
(45) Date of Patent: Apr. 7, 2009

(54) NEEDLE HOLDER OF MULTIPLE NEEDLES FOR SEWING MACHINE

(76) Inventor: Hsien-Chang Tseng, 9F, No. 270, Gaogong Rd., South District, Taichung City 402 (TW)

( * ) Notice: Subject to any disclaimer, the term of this patent is extended or adjusted under 35 U.S.C. 154(b) by 40 days.

(21) Appl. No.: 11/797,178

(22) Filed: May 1, 2007

(65) Prior Publication Data

US 2008/0271659 A1 Nov. 6, 2008

(51) Int. Cl.
*D05B 55/02* (2006.01)
*D05B 55/12* (2006.01)

(52) U.S. Cl. ..... 112/226

(58) Field of Classification Search ..... 112/222, 112/225, 226, 227, 258, 259
See application file for complete search history.

(56) References Cited

U.S. PATENT DOCUMENTS 1,299,242 A * 4/1919 Seymour ..... 112/226
1,401,466 A * 12/1921 De Voe ..... 112/226
1,430,930 A * 10/1922 Berger ..... 112/226
1,764,865 A * 6/1930 Barber ..... 112/226
2,792,798 A * 5/1957 Zink ..... 112/226
6,079,342 A * 6/2000 Tseng ..... 112/226

* cited by examiner

*Primary Examiner*—Ismael Izaguirre
(74) *Attorney, Agent, or Firm*—Banger Shia

(57) ABSTRACT

The present invention refers to a needle holder of multiple needles, the needle holder is connected with a needle bar on one end and equipped with a needle receiver with several open needle accommodating parts on the other end, so that it is convenient to process and manufacture. With cooperation of a needle retainer, the needle accommodating part of the needle receiver can become a closed structure to allow the ends of the needles to insert and be fixed on position by a needle fastening member on the needle retainer. Wherein, due to the open structure of the whole needle receiver of the needle holder, the manufacture is more precise and accurate, in addition, the processing, maintenance and replacement are more convenient, so as to become a structure of high precision and easy manufacture.

8 Claims, 5 Drawing Sheets

NEEDLE HOLDER OF MULTIPLE NEEDLES FOR SEWING MACHINE

FIELD OF THE INVENTION

The present invention generally relates to a needle holder of multiple needles, and more particularly to a needle holder of multiple needles of a sewing machine. With the design of an open needle accommodating part, the manufacture of the needle holder is more precise, and the fixing of the needles is more accurate and stable by means of the simplified corresponding components and structures to achieve the objectives of high stabilization and low manufacture cost.

BACKGROUND OF THE INVENTION

Conventional structures of needle bases or needle holders of sewing machines generally comprise the structure of single needle and multiple needles. In which, most of the structures of needle holder of multiple needles are drilled several holes on a metal block, the holes may be straight holes or taper holes. Such structures may be seen on traditional or other various sewing machines, for example TW 86200304, the needle protection device of a sewing machine, No. 91204735, an improvement of a stitch auxiliary device of a sewing machine, No. 92205688, a slanting pilot thread connecting rod of a sewing machine, and No. 93212570, an improvement of bi-needle all directional turning structure of a sewing machine, have been approved. The structure of the needle holder or needle base connected with needles is arranged holes in accordance with the number of needles on a block that is connected with the lower end of a needle bar so as to allow the upper ends of needles to insert and to be fixed by fastening screws. Such small volume is provided with two to five holes for receiving the needles, such that the locations of the holes must be precise and the depth of drilling must cooperate with the demand of the accuracy. Therefore, the accuracy of processing is very important. It is easy to have defective product out of the process with slight carelessness, so this needs to be improved.

Some of the former cases applied by this inventor have been approved, in which such as TW 94121063, the needle assembly structure of embroidery machine, which discloses the structure of a needle assembly for embroidery. The needle assembly also uses the structure of needle base of multiple needles, but the needle base still uses a block that is provided with several holes for receiving the corresponding number of needles. In order to make the manufacture and producing of needle bases of multiple needles more precise, the inventor invents TW 88200444, a structure of a needle holder with open needle fixing groove, which designs a structure of a needle holder for multiple needles. The structure of a needle holder is provided with several blocks so that each of the needle fixing grooves enables to accommodate the upper end of the needle and the needles can be fixed rapidly. Thus the manufacture can be fast and in high precision, and the defective products can be lowered to the minimum, which is to say a high quality and low cost structure, additionally the shortcomings of imprecision for traditional perforated needle fixing groove can also be resolved, the efficacy is much improved in comparison with traditional structure so it was granted with patent in the past; nevertheless the inventor continue his original enthusiasm in invention to invent a whole new structure for the needle holder of multiple needles, which can serve varieties of users' demands especially the user of embroidery machine.

SUMMARY OF THE INVENTION

Being aware of the shortcomings mentioned above, to have a needle holder that is suitable for a sewing machine with multiple needles and easy to manufacture precisely and low cost, the inventor developed a needle holder of multiple needles that be fulfill the requirements mentioned above.

The main objective of the present invention is to provide a needle holder of multiple needles, in which the end of the needle holder connected with needles is designed as the structure of a needle receiver with open needle accommodating parts. Due to the open structure, the manufacture of the needle receiver of the needle holder is more convenient and precise, and the annular needle retainer is able to arrange on the outside of the needle receiver of the needle holder. Furthermore, the inner of the needle retainer is formed as a needle fixing part corresponding to the shape of the needle receiver, and a needle fastening part is formed thereon perpendicular to the needle fixing part for a needle fastening member to engage therein firmly. Due to the simplified structure, the whole structure of the needle holder including other corresponding components achieves the functions of high preciseness, high quality and low manufacture cost.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
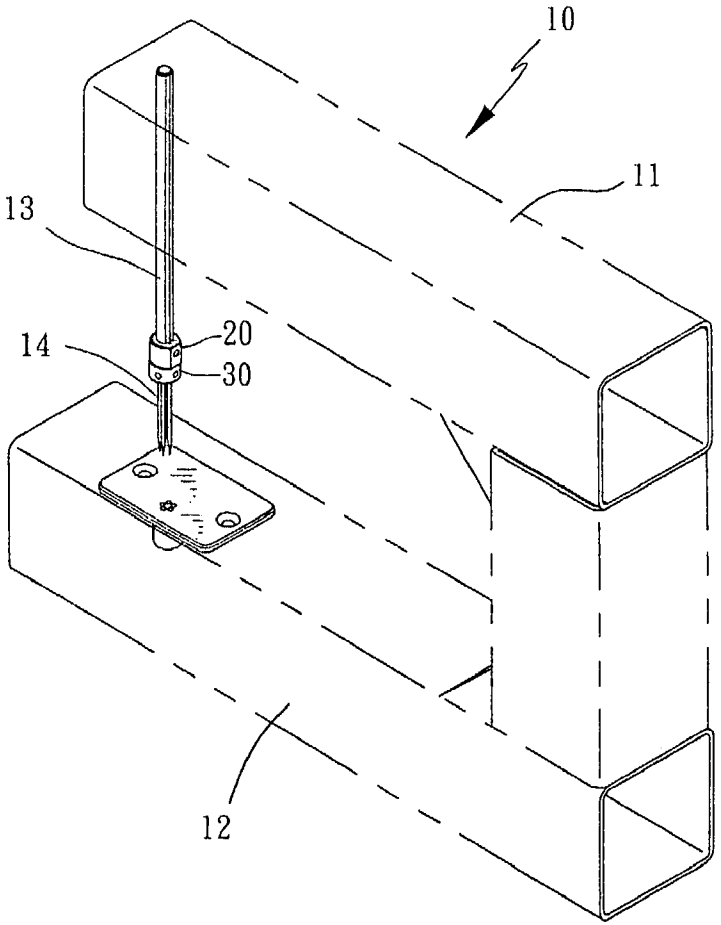
FIG. 1 is a perspective view of the appearance of the present invention.
Figure 2:
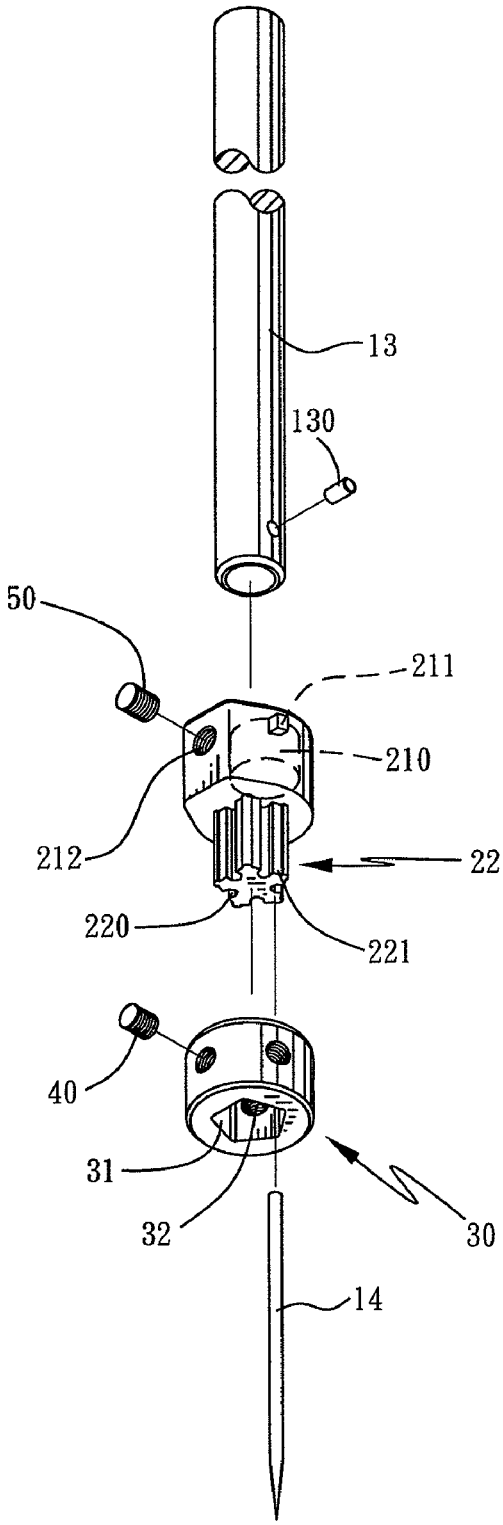
FIG. 2 is an exploded view of the present invention.
Figure 3:
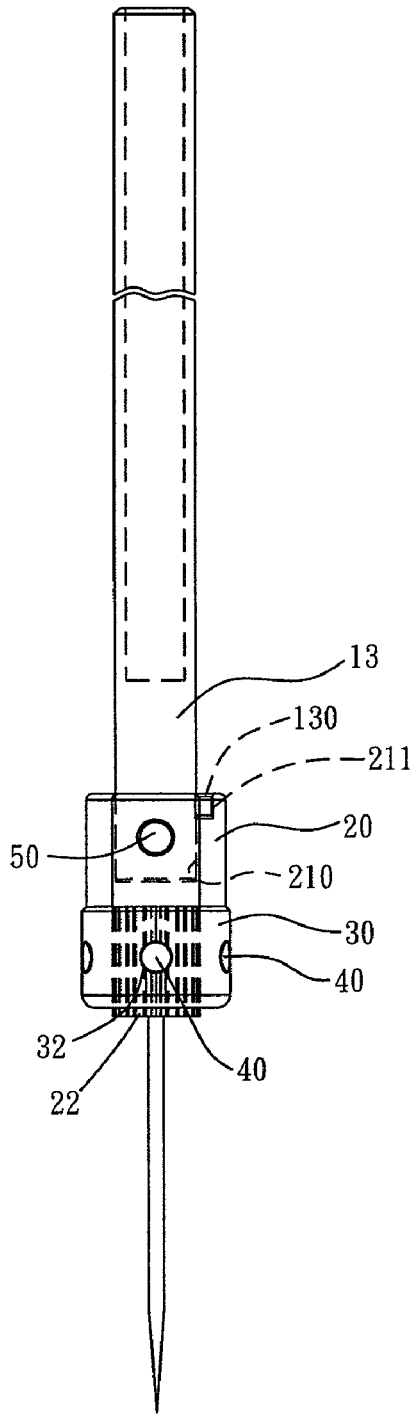
FIG. 3 is a plan view of the assembly of the present invention.
Figure 4:
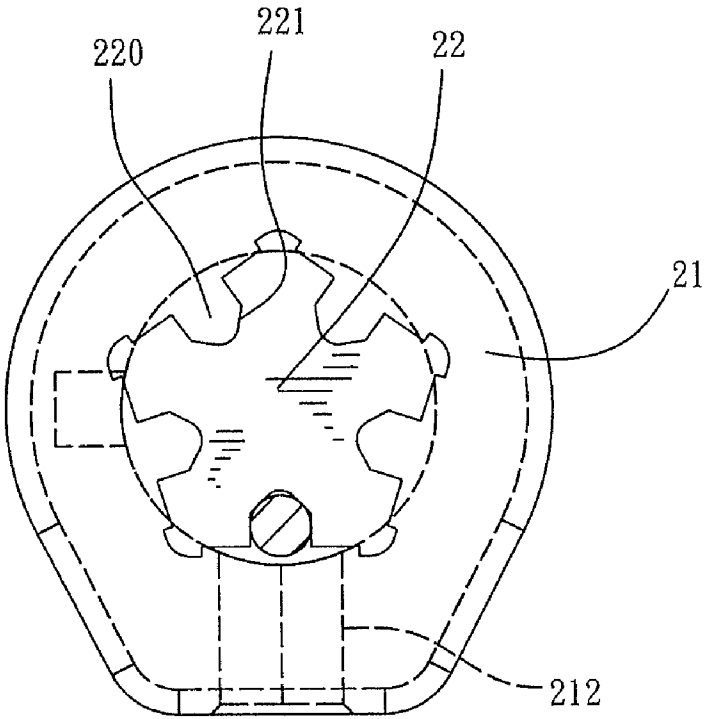
FIG. 4 is a bottom view of the needle holder of the present invention.
Figure 5:
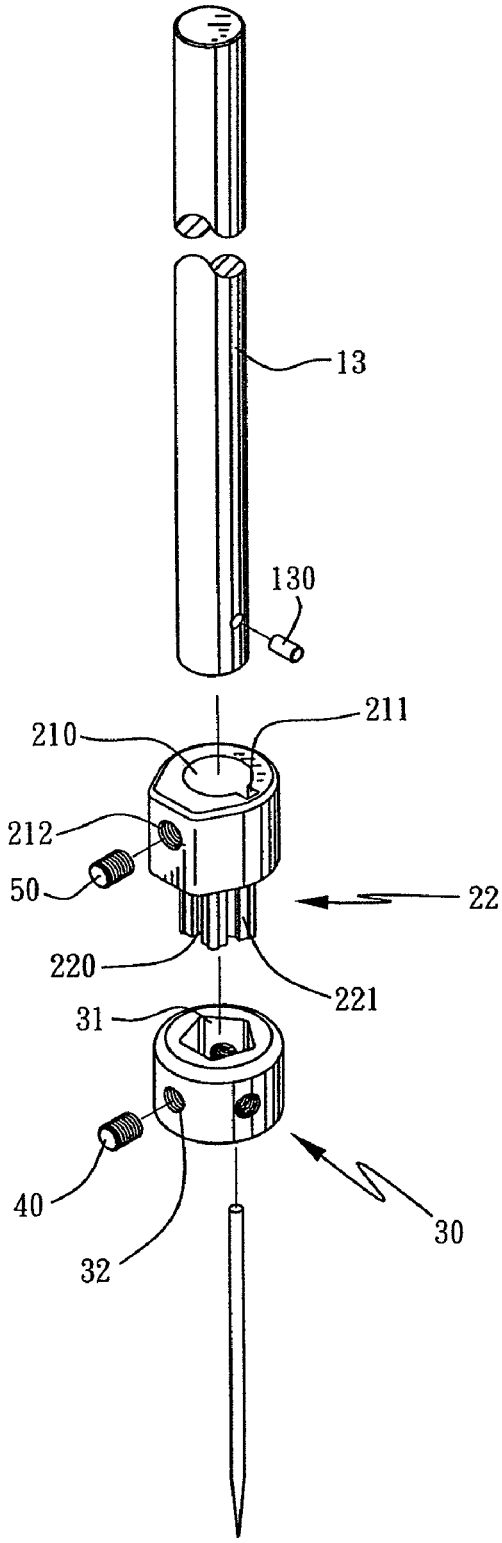
FIG. 5 is an exploded view of the present invention from another angle.

Referring to FIGS. 1, 2 and 3, a sewing machine 10 of the present invention includes a cantilever 11. The bottom of the cantilever 11 is connected with a transverse machine base 12, and the end of the cantilever 11 is connected with a needle bar 13 that is driven by a driving mechanism. The driving mechanism is similar to a traditional driving mechanism of a sewing machine, which is not the emphasis of the present invention so that it will not be described here. The end of the needle bar 13 is equipped with several needles 14. A needle holder 20 is provided between the needles 14 and the needle bar 13, and the needle holder 20 is equipped with a needle retainer 30 relative to the needles 14 for fixing the several needles 14 by cooperating with several needle fastening member 40. The needle holder 20 is locked on the needle bar 13 via a fastening member 50.

Wherein, the end of the needle bar 13 is equipped with a pin of positioning member 130 for positioning the needle holder 20 rapidly.

The needle holder 20 is equipped with a bar receiver 21 on one end relative to the needle bar 13 and a needle receiver 22 on the other end. The bar receiver 21 is in the form of a cylinder and has a round cavity of bar holder 210 relative to the needle bar 13. The bar holder 210 has a recess of positioning part 211 for receiving the positioning member 130. The needle holder 20 is attached to the needle bar 13 by accurate positioning of the positioning member 130 and the positioning part 211 with each other so as to retain the needle holder 20 on the correct position. Thus, the several needles 14 on the needle holder 20 are able to precisely aim at the plate mounted on the surface of the machine base 12 of the sewing machine 10.

The needle holder 20 has a threaded hole of fastening part 212 perpendicular to the direction of the bar holder 210 for inserting the fastening member 50 to fasten the needle bar 13.

The needle receiver 22 provided on the other end of the needle holder 20 is in the form of a polygonal body with an asterisk cross-section. The number of the surfaces of the polygonal body of the needle receiver 22 is in accordance with the assembling number of the needles 14, and the center of each surface is formed a groove of needle accommodating part 220 along the longitudinal axis. The needle accommodating parts 220 are penetrated relative to the ends of the needles 14 and the indents of the needle accommodating parts 220 are open outwardly. The bottoms of the grooves of the needle accommodating parts 220 are formed as V-shaped guiding structures of guiding parts 221. With the arrangement of the guiding parts 221, while the needles 14 are inserted therein, the side walls of the needles 14 are guided by the guiding parts 221 to locate on the center precisely.

The outside of the needle receiver 22 of the needle holder 20 is arranged with a needle retainer 30 in the form of a ring that has a polygonal inner surface corresponding to the needle receiver 22. The central opening of the needle retainer 30 is formed as a polygonal needle fixing part 31, and the center of each polygonal surface of the needle fixing part 31 has an threaded hole of needle fastening part 32 perpendicular to the surface of the needle fixing part 31 so as to allow a needle fastening member 40 to engage within the needle fastening part 32. The needle fastening member 40 is a threaded pin for engaging within the needle fastening part 32 to fasten the needle 14 on the needle fixing part 31, so that the needle 14 is fixed inside the needle fixing part 31.

When the needle retainer 30 is put around the needle receiver 22 of the needle holder 20, the length of the needle receiver 22 is slightly longer than the height of the needle retainer 30 so that the end of the needle receiver 22 is slightly protruded out of the bottom of the needle retainer 30. Thus the needle retainer 30 can be fixed to the needle receiver 22 of the needle holder 20 directly by means of rivet or C-shaped clamp.

The structure mentioned above will have functions as follows:

1. Easy manufacture for an integrated structure: installation of the needle holder 20 and the needle retainer 30 does not require drilling works for the corresponding needles 14. Besides, the design of the needle receiver 22 of the needle holder 20 for accommodating the needles 14 is an open structure, so it is convenient and fast in manufacturing comparing to traditional needle holders or needle bases of multiple needles.
2. High accuracy and precision about the structure of accommodating the needles 14: since the structure of the needle accommodating parts 220 on the needle receiver 22 for accommodating the needles 14 is an open structure, there is no need to drill but to work on exterior directly in assemblies processing.
3. Reasonable structural design: regarding the fixing of the needles 14, the needle fastening members 40 would be used to fix on the needle holder 20; besides, the needles 14 will be effectively led by the guiding parts 221 of the needle accommodating parts 220 to the most precise locations, the overall design is extremely reasonable and effective, the needles 14 can be positioned at their most precise locations for sewing works to proceed efficiently.
4. Reduce the damages on the needles 14 and the relevant parts: because of high precision for the needles 14 installation, the needles 14 will not hit on relevant structure of locations shifting in use, which will not diminish the structural stability, unnecessary damages of hitting caused by the needle 14 and the relevant assemblies will be prevented as well, the lifetime of the whole structure can be effectively extended.

While we have shown and described the embodiment in accordance with the present invention, it should be clear to those skilled in the art that further embodiments may be made without departing from the scope of the present invention.

What is claimed is:

1. A needle holder of multiple needles comprising:

a sewing machine including a cantilever, a bottom of the cantilever connected with a machine base and an end of the cantilever driving a needle bar, an end of the needle bar equipped with several needles, a needle holder provided between the needles and the needle bar;

said needle holder being equipped with an open needle receiver for accommodating needles, a needle retainer in the form of a ring that has an inner surface formed corresponding to the needle receiver being arranged outside the needles; and said needle retainer equipped with several needle fastening members relative to the needles for fixing the needles.

2. The needle holder of multiple needles as claimed in claim 1, wherein the needle bar is equipped with a positioning member on one end relative to the needle holder, and the needle holder is formed with a positioning part which cooperates with the positioning member of the needle bar to quickly retain the needle holder into correct position.

3. The needle holder of multiple needles as claimed in claim 1, wherein the needle holder is equipped with a bar receiver on one end relative to the needle bar and the needle receiver on the other end relative to the needles.

4. The needle holder of multiple needles as claimed in claim 3, wherein the bar receiver is equipped with a bar holder relative to the needle bar and the bar holder has a positioning part.

5. The needle holder of multiple needles as claimed in claim 4, wherein the needle holder is equipped with a fastening part perpendicular to a direction of the bar holder, a fastening member engaged within the fastening part to fasten the needle bar.

6. The needle holder of multiple needles as claimed in claim 1, wherein the needle receiver is provided on the other end of the needle holder and is in accordance with the assembling number of the needles, a center of each surface of the needle receiver formed a groove of needle accommodating part along a longitudinal axis, the needle accommodating part being penetrated relative to an end of the needle and an indent of the needle accommodating part being open outwardly, the needle accommodating part formed as a guiding structure of guiding part.

7. The needle holder of multiple needles as claimed in claim 1, wherein the needle retainer is equipped with needle fixing part in a central opening of the needle retainer and the needle fixing part has a needle fastening part perpendicular to the needle fixing part on the central surface so as to allow a needle fastening member to engage within the needle fastening part.

8. The needle holder of multiple needles as claimed in claim 1, wherein a length of the needle receiver of the needle holder is slightly longer than a height of the needle retainer.

* * * * *